US005494264A

United States Patent [19]

Wolff et al.

[11] Patent Number: 5,494,264

[45] Date of Patent: Feb. 27, 1996

[54] DEVICE FOR THE ALTERNATE WINDING-UP AND UNWINDING OF STRIP-SHAPED MATERIAL

[75] Inventors: Hartmut Wolff, Düsseldorf; Herbert Quambusch, Ratingen, both of Germany

[73] Assignee: Mannesmann Aktiengesellschaft, Düsseldorf, Germany

[21] Appl. No.: 320,580

[22] Filed: Oct. 11, 1994

[30] Foreign Application Priority Data

Oct. 8, 1993 [DE] Germany ..... 43 34 826.2

[51] Int. Cl.[6] ..... C21D 9/54

[52] U.S. Cl. ..... 266/103

[58] Field of Search ..... 266/102, 103; 148/657, 601; 432/59, 65

[56] References Cited

U.S. PATENT DOCUMENTS 5,131,134 7/1992 Quambusch et al. ..... 432/65

FOREIGN PATENT DOCUMENTS 0177187 4/1986 European Pat. Off. .
9720603 9/1951 Germany .
4013582 7/1991 Germany .

*Primary Examiner*—Scott Kastler
*Attorney, Agent, or Firm*—Cohen, Pontani, Lieberman, Pavane

[57] ABSTRACT

A device for the alternate winding-up and unwinding of strip-shaped material, particularly strand-cast thin slabs in furnace pairs, consisting of two furnaces that are located one above the other and have horizontal winding axles, in which the furnaces can be swung from a winding-up position in an unwinding position and the winding-up and unwinding take place at different speeds. To permit winding-up in one of the two furnaces and unwinding in the other furnace to occur simultaneously and in different directions, each furnace of a furnace pair is pivotable around a vertical axis independent of the other furnace.

7 Claims, 2 Drawing Sheets

DEVICE FOR THE ALTERNATE WINDING-UP AND UNWINDING OF STRIP-SHAPED MATERIAL

BACKGROUND OF THE INVENTION

1. Field of the Invention

The invention relates to a device for the alternate winding-up and unwinding of strip-shaped material, particularly strand-cast thin slabs in furnace pairs, consisting of two furnaces that are located one above the other and have horizontal winding axles. In which device the furnaces can be swung from a winding-up position into an unwinding position and winding-up and unwinding take place at different speeds.

2. Description of the Prior Art

A generic winding device is known, for example, from DE 40 13 582 C1. This device is integrated into a unit which produces a hot-rolled strip of strand-cast input material, and it serves to compensate for the differences in speed between the strand casting and the rolling by temporarily storing the strip. The winding-up of the strip occurs in furnaces, so that uniform temperature conditions are achieved for the subsequent processing of the strip, which is then unwound from the furnaces, in the downstream finishing rolling mill.

Another winding device with furnaces located one above the other is known from EP 01 77 187 A1. In this device, in a manner similar to that known from DE 40 13 582 C1, the furnaces are alternately used for winding-up the strip, and the furnace which is not being used at a given time for winding-up the strip feeds the rolling mill by unwinding the previously wound-up strip.

The generic solution calls for the furnaces to be closed to large extent, in order to minimize heat loss during the winding-up and unwinding of the strip.

Both of the solutions described above require the strip-shaped material being wound-up, such as the strand-cast thin slab, to be fed in the same direction as the direction in which the unwound material is borne away, i.e., the rolling mill must be aligned with the upstream unit, which may be a thin-slab casting machine or the roughing train of a wide-strip train. However, space conditions often do not permit these two elements to be lined up in a straight line in front of and behind the furnace, particularly when existing units are being rebuilt. In such cases, the known winding-up and unwinding devices cannot be used. Although the idea of providing furnace pairs, each of which consists of two furnaces located one above the other on a shared rotary table is known from DE-PS 972 603 (FIGS. 3 and 4), which would theoretically allow the winding-up and unwinding sequences to be carried out in different directions, the furnace pairs in the known solutions are attached to the shared rotary table in such a way that while winding-up is in progress, unwinding in a different direction is not possible.

SUMMARY OF THE INVENTION

Starting from this prior art, it is an object of the present invention to provide a device for the alternate winding-up and unwinding of strip-shaped material which permits winding-up to occur in one of the furnaces while, simultaneously, unwinding occurs in the other furnace in a different direction. Pursuant to this object, and others which will become apparent hereafter, one aspect of the present invention is that each furnace in a furnace pair is pivotable around a vertical axis independent of the other furnace.

Thus, the present invention departs from the prior art in which, even though two furnaces are pivotable independent of each another, pivoting occurs around horizontal axes corresponding to the winding axle. The present invention makes it possible, in a surprisingly simple manner, to wind up a strip in one of the furnaces while simultaneously performing an unwinding sequence in a different direction in a different furnace, which has been pivoted around a vertical axis. Thus a furnace pair of the invention can connect, for example, a thinslab casting machine and a downstream finishing train which are located at an angle to one another.

It is preferable to have both furnaces pivot around a common axle. When the axle around which the furnaces can be swung intersects the winding axle at the winding axle's midpoint, the final pivot positions will always be correct for attaching the upstream or downstream parts of the unit.

A further embodiment of the invention calls for a horizontal passage between the furnaces for strip-shaped material that is not to be wound. The fact that each furnace is designed as a self-contained element, in order, as mentioned earlier, to minimize heat loss, also means that it is possible to convey between the furnaces any strip-shaped material which, for some reason, is not to be wound up.

In another embodiment of the invention, each furnace can be swung by 90 degrees between the winding-up and the unwinding positions.

With the features described above, the invention, in a particularly advantageous manner, permits a furnace pair to be located behind each strand of a multi-strand thin-slab casting machine and in front of a common finishing train, while horizontal conveyor tables for the strip-shaped material are provided between the two furnace pairs and simultaneously between the two furnaces of the furnace pair closer to the finishing mill.

The invention, with furnaces that can be pivoted independently around vertical axles, makes it extremely simple to connect a plurality of strands from a casting machine to a single finishing train. To accomplish this requires that the finishing train be located at right angles to the multiple casting strands (two or more) and that each furnace be pivotable into a position aligned with the casting machine and a position aligned with the finishing train. The furnace pairs of the individual casting strands are located one behind the other in the direction of the finishing train so that the strip-shaped material that is unwound from the furnace pair farther away from the finishing train can be conveyed through the passage which exists between the furnaces of the furnace pair adjacent to the finishing train. In this way, it is very simple to connect different casting strands to one another, whereby, according to another feature of the invention, the conveyor tables are preferably housed in a fashion that is at least partially heatinsulating.

It has been found that an especially advantageous solution includes accommodating each furnace of a furnace pair in a carrying rack which is attached in a rotatable fashion to a rotating ring having a center axis that corresponds to the pivot axis of the furnaces.

The inventive device provides a further advantage by virtue of the fact that the furnaces pivotable around vertical axles can be equipped with permanent chimney connections if these connections are attached rotatably to the furnaces concentric to the oven pivot axles. When chimney connections existed in the prior art, it was necessary to detach these connections prior to pivoting and to reconnect them again after pivoting. This was disadvantageous for reasons of environmental protection.

An example of the invention is described below in reference to a two-strand thinslab casting machine with a downstream finishing mill.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
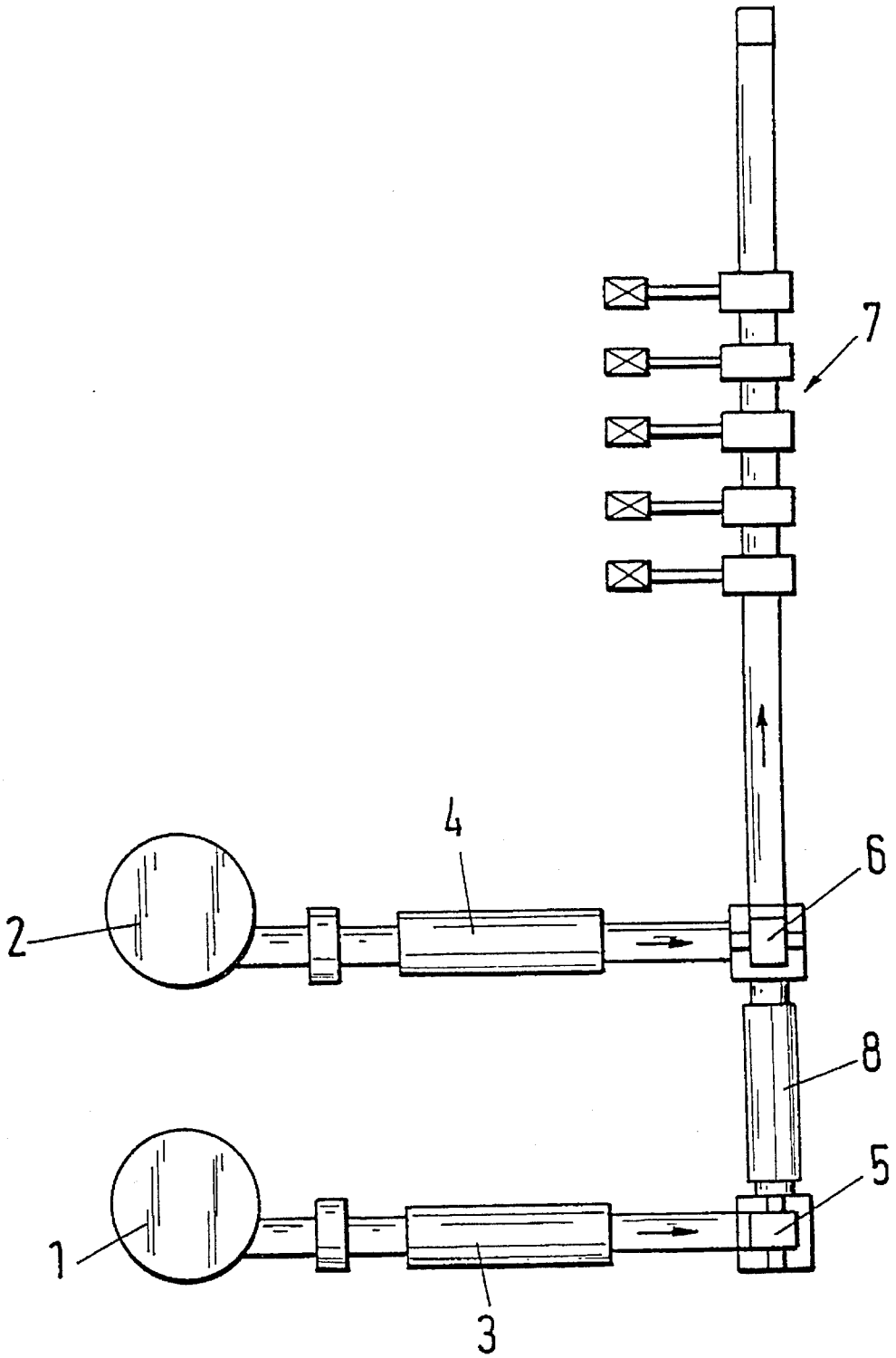
FIG. 1 is a top view of the entire unit pursuant to the invention.

In FIG. 1, the reference numbers 1, 2 indicate thin-slab casting machines located parallel to one another in which preshaped input strip is produced. After inductive heating 3, 4 and homogenization, the strip is fed to a furnace pair 5, 6, where the strip-shaped material is reeled up in one of the two furnaces which are located one above the other.

In the other furnace of each of the furnace pairs 5, 6, the strip-shaped material that has been wound-up is brought, after the furnace has been swung by 90 degrees, into its unwinding position and is unwound in the direction of the finishing train 7. The strip-shaped material is conveyed from the furnace pair 5 via the housed conveyor table 8 arranged between the furnaces of the furnace pair 6 and is thus able to pass without obstruction into the finishing mill 7.

Figure 2:
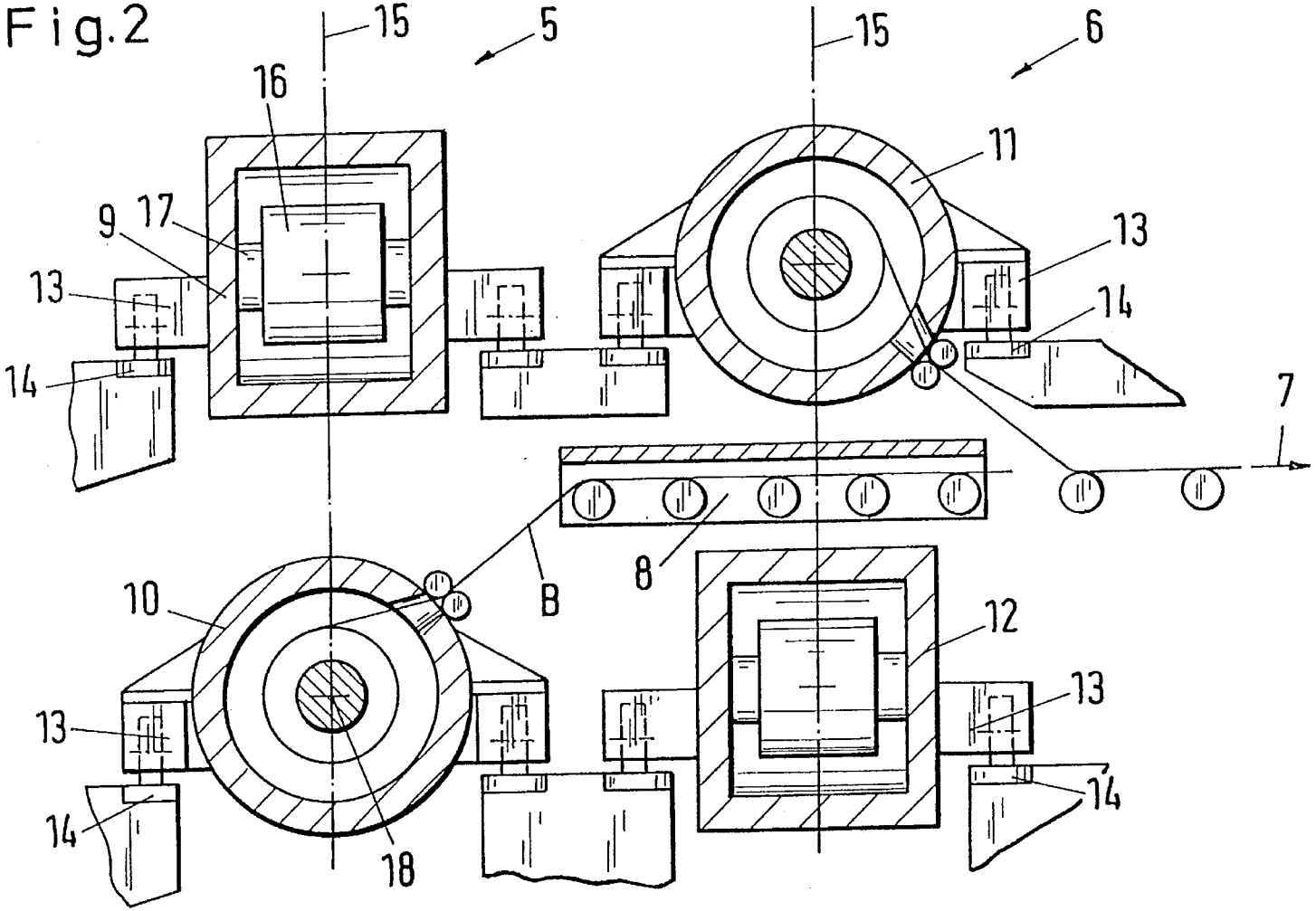
FIG. 2 is a vertical section through the two furnace pairs associated with the casting machines.

FIG. 2 is a rough diagram showing the arrangement of the two furnace pairs 5, 6. The furnaces of furnace pair 5 are indicated by 9 (upper furnace) and 10 (lower furnace), while the furnaces of furnace pair 6 are indicated by 11 and 12. Each of the furnaces 9 to 12 is located in a carrying frame 13 and can be pivoted on circular tracks 14 around the vertical axis 15. The furnaces 9, 10 as well as the furnaces 11, 12, respectively, are shown pivoted by 90 degrees relative to each another, corresponding to their winding-up and unwinding positions. When, for example, a strip of the strip-shaped material is being wound up in furnace 9, as indicated by 16, around the horizontal winding axle 17, the strip that has been wound around the winding axle 18 can be unwound out of furnace 10. The strip-shaped material "B" is conveyed via the housed conveyor table 8 between the furnaces 11 and 12 of the furnace pair 6 to the finishing train 7. Meanwhile, a strand coming from the thin-slab casting machine 1 or 2 can be wound up in one of the furnaces 11 and 12, just as in furnace 9.

In the same way, it is also possible to connect a plurality of casting strands with each other, so that an extremely flexible unit can be created by very simple means. Naturally, the application of the invention is not limited to thin-slab casting machines with downstream finishing trains. Wide-band trains can also be improved in an advantageous manner with the device according to the invention.

In addition to permitting rotation, the separate accommodation of the furnaces 9 to 12 in the carrying frame 13 makes it possible for an entire furnace unit to be moved out laterally into a maintenance position outside the train, so that repairs can be carried out on one of the furnaces 9, 10 or 11, 12 of the furnace pair 5 or 6 while the remaining furnace is used to maintain operations at reduced output.

The suggested device as well as a unit equipped with this device is distinguished by particular simplicity in design and in control. The space that can be saved by the invention is significant in respect not only to the size of the unit, but also to the thermal conditions, because the losses between individual unit parts become lower as the unit becomes shorter.

The invention is not limited by the embodiments described above which are presented as examples only but can be modified in various ways within the scope of protection defined by the appended patent claims.

We claim:

1. A device for alternate winding-up and unwinding of strip-shaped material, comprising furnace pairs having two furnaces located one above the other and having horizontal winding axles, the furnaces being adapted to be swung out of a winding-up position into an unwinding position, winding-up and unwinding taking place at different speeds, each furnace of each furnace pair being independently pivotable around a common vertical axis so that each furnace of the pair can pivot independently of the other furnace of the pair.

2. A device as defined in claim 1, wherein the axis around which each furnace is pivotable intersects the winding axle at its center.

3. A device as defined in claim 1, and further comprising a horizontal passage between the furnaces of each pair for strip-shaped material that is not to be wound.

4. A device as defined in claim 1, wherein each furnace is adapted to be pivoted by 90 degrees between the winding-up position and the unwinding position.

5. A device as defined in claim 1, wherein each of the furnace pairs is located behind one strand of a multi-strand thin-slab casting unit and in from of a common finishing mill so that one furnace pair is closer to the finishing mill than the other, and further comprising horizontal conveyor tables for the strip-shaped material provided between the two furnace pairs and simultaneously between the furnaces of the furnace pair closer to the finishing mill.

6. A device as defined in claim 5, wherein the conveyor tables are at least partially heat-insulated.

7. A device as defined in claim 1, and further comprising a plurality of carrying racks, each of the furnaces being accommodated in a respective one of the carrying racks, and a plurality of rotating rings each having a center axis which corresponds to the pivot axis of the furnaces, each one of the carrying racks being rotatably connected to one of the rotating rings.

* * * * *